US005641142A

United States Patent [19]

Hanson et al.

[11] Patent Number: 5,641,142

[45] Date of Patent: Jun. 24, 1997

[54] LADDER TRAY

[76] Inventors: June Arlene Hanson; John Hanson, both of 3 Charlbury Road, Medindie Gardens, Australia

[21] Appl. No.: 552,371

[22] Filed: Nov. 3, 1995

[30] Foreign Application Priority Data

Nov. 4, 1994 [AU] Australia ..... PM9274

[51] Int. Cl.[6] ..... F06C 7/14

[52] U.S. Cl. ..... 248/238; 248/210; 182/129

[58] Field of Search ..... 248/210, 238; 182/129

[56] References Cited

U.S. PATENT DOCUMENTS

| | | | |
|---|---|---|---|
| 1,557,278 | 10/1925 | Tussing | 248/238 |
| 2,109,885 | 3/1938 | Lewis . | |
| 2,643,808 | 6/1953 | McAlister . | |
| 3,104,859 | 9/1963 | Hoetzel . | |
| 3,108,776 | 10/1963 | Cook . | |
| 3,131,900 | 5/1964 | Anderson et al. . | |
| 3,422,923 | 1/1969 | Lund | 182/129 X |
| 3,842,936 | 10/1974 | De Luca | 182/129 |
| 4,212,371 | 7/1980 | Gaviorno, Jr. | 248/238 X |
| 4,261,435 | 4/1981 | Winter | 182/129 |
| 4,276,955 | 7/1981 | Hickman | 182/129 X |
| 4,589,521 | 5/1986 | Finster et al. | 182/129 |
| 4,643,274 | 2/1987 | Tataseo | 182/129 X |
| 4,646,878 | 3/1987 | Moyer | 248/238 X |
| 4,756,384 | 7/1988 | Maddox | 182/129 X |
| 4,862,994 | 9/1989 | Hughes, Sr. | 182/129 X |
| 5,275,256 | 1/1994 | Ellzey | 248/238 X |
| 5,342,008 | 8/1994 | Kay | 248/210 X |
| 5,429,205 | 7/1995 | Collins | 248/238 X |

FOREIGN PATENT DOCUMENTS

| | | | |
|---|---|---|---|
| 3376 | 9/1975 | Australia . | |
| 6061480 | 7/1980 | Australia . | |
| 2016583 | 10/1983 | Australia . | |
| 615815 | 10/1991 | Australia . | |
| 360049 | 3/1990 | European Pat. Off. | 182/129 |
| 4428265 | 8/1994 | Germany . | |
| 2192025 | 12/1987 | United Kingdom | 248/238 |
| 2193523 | 2/1988 | United Kingdom | 248/238 |

*Primary Examiner*—Alvin C. Chin-Shue
*Assistant Examiner*—Richard M. Smith
*Attorney, Agent, or Firm*—Watts, Hoffmann, Fisher & Heinke Co., L.P.A.

[57] ABSTRACT

A ladder tray (10) is provided with a generally rectangular tray (11 ) having a panel (12) surrounded by a flange (28) which projects both above and below the panel. Two pairs of slides (31) can slide along the flange (28) at respective ends (15, 16) and the slides (31) carry the upper ends of legs (32) of U-shaped tray supports (26). The slides also include lockable pivot screws (33) which can lock both the legs (32) and the slides (31) against movement and allow bridge portions (25) of the tray supports (26) to bear against a portion of a ladder to which the tray assembly (10) is attached.

10 Claims, 3 Drawing Sheets

LADDER TRAY

This invention relates to a ladder tray assembly which is suitable for being supported at the top of a ladder. Ladder trays, per se, are very well known and for example prior art includes Australian Patent No 615815 (Bailey), U.S. Pat. No. 2109886 (Lewis), U.S. Pat. No. 2643808 (McAlister). U.S. Pat. No. 3131900 (Anderson) (which relates to a paint pot holder), U.S. Pat. No. 3104859 (Hoelzel) (which, like Anderson, relates to a paint bucket support bracket) and U.S. Pat. No. 3108776 (Cook) (which also relates to the same type of device as Anderson and Hoelzel).

One of the characteristics which is common to most of the above patent applications and patents is that the trays are designed for use solely on a manufacturer's ladder, and are not suitable for ladders of other types or manufacturers. However, there is e requirement for a tray which can carry tools, paint tins or the like, and which can be adaptable to a wide range of step ladders. There is also a requirement for such a tray for use with a ladder having only stiles and rungs, and this invention Is directed to improvements in the configuration of a tray wherein it is adaptable for use with a range of step ladders, and, the necessary changes being made, for a ladder having only stiles and rungs.

In this invention, a ladder tray assembly is provided with a tray having a panel bordered by a pair of transverse sides and a pair of ends, ladder engaging means adjacent one of said transverse sides, guide surfaces extending along the tray adjacent respective said ends, and slides engaging said guide surfaces to be guided thereby for movement towards or away from said one of the transverse sides, a pair of tray supports each having two upstanding legs upper ends of which pivotally engage and depend from respective said slides, and a bridge connecting lower ends of said legs, the bridge comprising a pivot which permits said legs to pivot with respect to each other at their lower ends.

An embodiment of the invention is described hereunder In some detail with reference to, and is Illustrated in, the accompanying drawings, in which.

Figures 3, 4A, 4B, 4C:
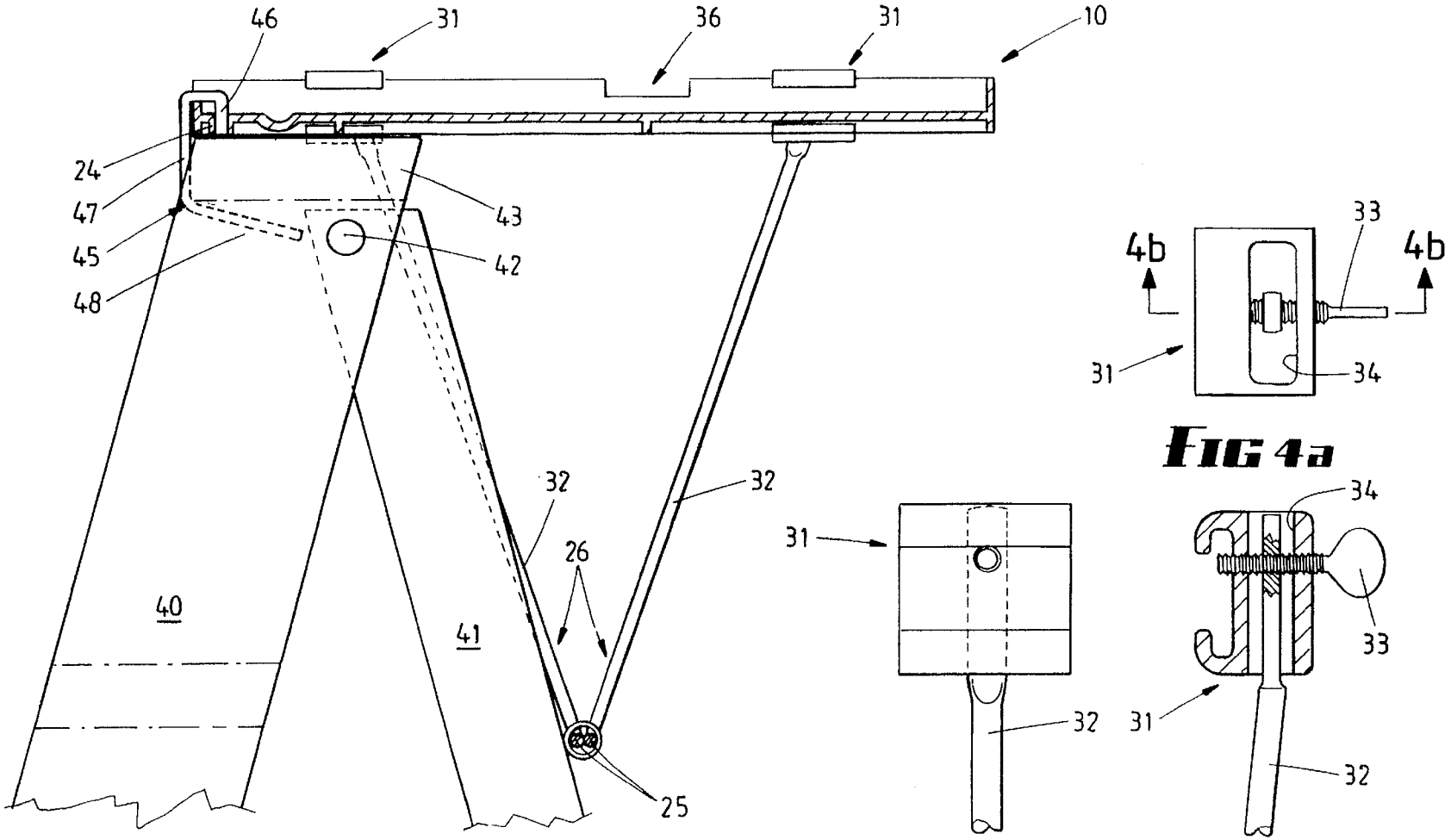
FIG. 3 is a fragmentary section taken on plane 3—3—3 of FIG. 1.

FIG. 4*a* is a plan view of a slide and illustrating the upper end of a leg pivoted there;

FIG. 4*b*is an elevational section taken on plane 4*b*—4*b* of FIG. 4*a*; and FIG. 4*c*is an end elevation of one end of the slide.

In this embodiment a ladder tray assembly 10 comprises a tray 11 which has a panel 12 which is bordered by a pair of transverse sides 13 and 14 and a pair of ends 15 and 16. The ends 15 and 16 are desirably defined by straight edges but the sides 13 and 14, although being shown as straight, can, if desired, be other than straight, for example to provide a space along the side 14 to accommodate part of the body of a user.

Ladders come in different configurations, and some utilise tubular stiles and stays with metal treads extending between the stiles, and such ladders frequently utilise hinge rods to hinge the stays with respect to the stiles, or have a single spacer rod between the top ends of the stiles. On the left hand side of FIG. 1, and also in FIG. 2, there Is shown a tubular stile 19 which is retained in a notch 20*a* of a spaced pair of notches 202, 206 in the near transverse side 14, and as shown in FIG. 2, a hinge rod (or spacer rod) 21 joins the stiles 19 to the stays 22, and a U-shaped retaining clip 23 extends through an aperture in a boas 24 near the side 14, and extends upwardly from the underside of the tray 11, The bridge of the U-shaped clip bears against the outer surface of the stile 19 to retain it against the walls which define the notch 2O*a*. As shown in FIG. 2, the stay 22 (shown in dashed lines) extends downwardly from the hinge rod 21, and the bridges 25 of two U-shaped tray supports 26 are tied together with wire so they can mutually pivot, and bear against the stay 22 to retain the tray 11 in a horizontal plane.

The sides 13 and 14 and ends 15 and 16 are all bordered by a vertical flange 28 which projects upwardly by a larger degree than it projects downwardly from the plane of the tray 11. This not only stiffens the tray 11 but also provides guide surfaces 29 and 30 which guide slides 31 (shown in detail in FIGS. 4*a*, 4*b* and 4*c*) for movement along the ends of the tray 11, and the upstanding legs 32 of tray supports 26 are pivoted to the slides 31 by means of respective pivot screws 33 which threadibly engage upper flattened ends of the legs 32, but the screws are freely rotatable in apertures in the slides 31. However, upon tightening of screws 33, the upper ends of the legs 32 are clamped against the inner surfaces 34 of the respective slides 31, as the screws bear against outer surfaces 30 of the flange 28. This is an effective way of inhibiting slidable movement once the level of tray 11 has been adjusted. the slides 31 each have inner surfaces which define open mouth slots and which slidably engage the guide surfaces 29 and 30.

In order to provide access for the slides 31, the ends 15 are provided with notches 36, which enable the slides 31 to be positioned over the upper and lower portions of the flange 28.

While some ladders are made from tubular metal of circular cross-section as illustrated. others may be made of rectilinear metal or of timber, and it is a feature of this invention that the tray assembly can be used on ladders which vary in shape and size, thus greatly increasing the application of the invention.

FIG. 3 illustrates a slightly different arrangement wherein the ladder stiles 40 are of timber and are supported by stays 41 pivoted thereto by hinge pins 42. It is conventional for such a ladder to have a step 43 at the upper ends of the stiles 40, and this is shown in some detail in FIG. 3, as wall as in FIG. 1. With the arrangement illustrated, the legs 32 of tray supports 26 depend as before from the slides 31, the slides 31 being positioned so that when the ladder is erected, the bridges 25 of the legs 32 bear against the outer surfaces of the stays 41.

Figure 1:
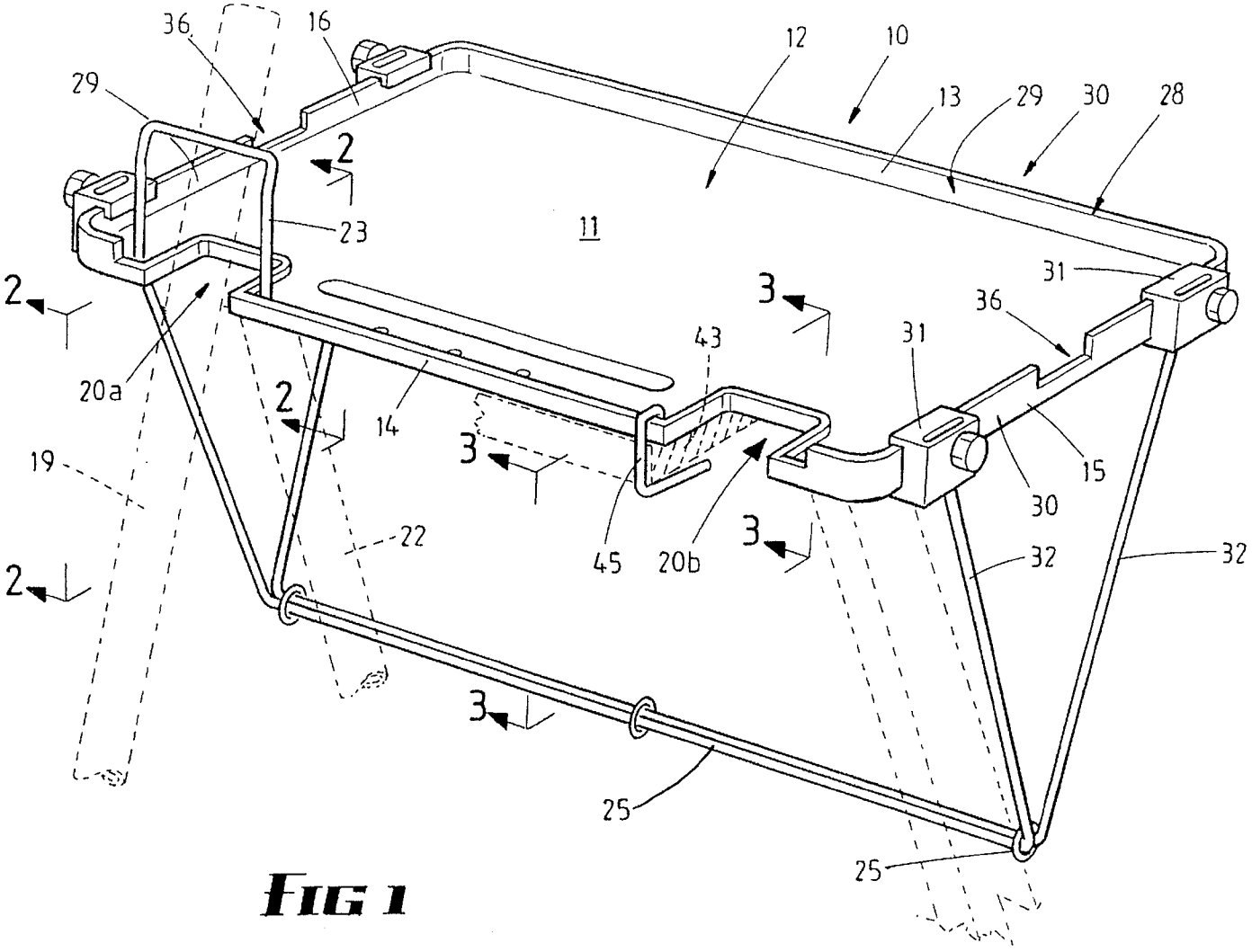
FIG. 1 is a perspective view of a ladder tray assembly which diagrammatically illustrates its attachment to two different types of ladder treads.
Figure 2:
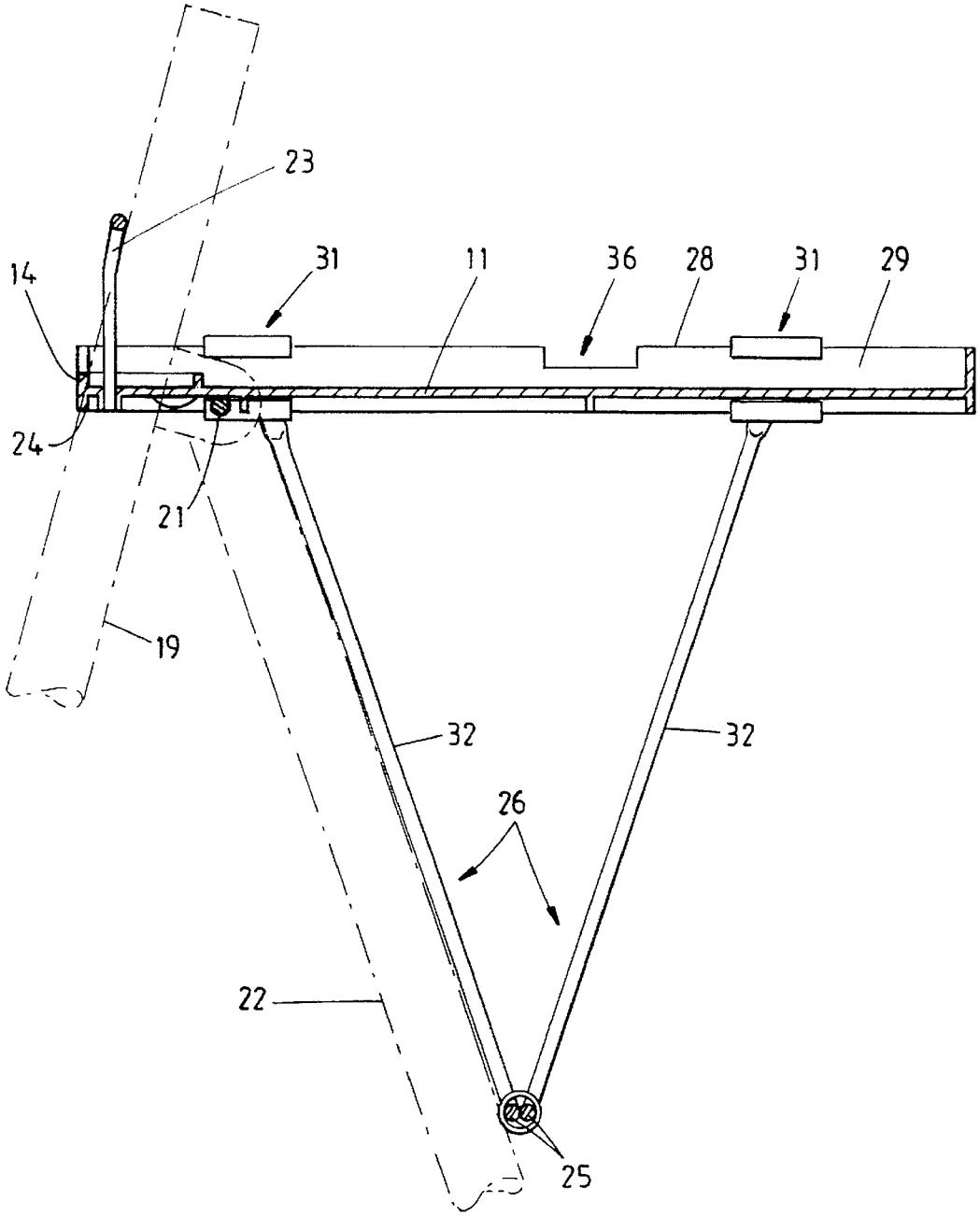
FIG. 2 is a fragmentary section taken on plane 2—2—2 of FIG. 1.

In lieu of the U-shaped retaining clips 23 illustrated in FIGS. 1 and 2, FIG. 3 shows a hook-like clip 45 which has a downturned upper end 46 which enters the aperture of boss 24 as in the first embodiment. A double return bend provides a downwardly extending intermediate portion 47 with an inwardly directed lower terminal portion 48 which engages the under surface of step 43 thereby firmly retaining the tray assembly 10 from rearward movement away from the step 43, while the bridge prevents forward movement by engagement with the rear surface of the stays 41. This arrangement is particularly shown in FIG. 3, but also partly shown in FIG. 1 which illustrates the timber ladder at the right hand side and the tubular ladder at the left hand side.

As shown the legs 32 of the tray supports 26 are of lengths which are equal or nearly equal. Obviously this is unsuitable for a ladder without stays, and to support a tray to such a ladder, the right hand support (as drawn in FIGS. 1, 2 and 3) must be longer than the others, which are closer to the stiles.

We claim:

1. A ladder tray assembly comprising:

a tray having a panel bordered by a pair of transverse sides and a pair of ends;

ladder engaging means adjacent one of said transverse sides;

guide surfaces extending along the tray adjacent respective said ends, and slides engaging said guide surfaces, said guide surfaces guiding said slides for movement toward or away from one of said sides;

a pair of tray supports each having two upstanding legs, the upper ends of said legs pivotally engaging and depending from respective said slides;

a bridge mechanism connecting lower ends of said legs, the bridge comprising a pivot which permits said legs to pivot with respect to each other at their lower ends;

the tray including flanges at the respective ends, the flanges projecting both upwardly and downwardly from said panel, said guide surfaces being inner and outer surfaces of said flanges;

said slides having inner surfaces defining open mouth slots; and, said slide inner surfaces slidably engaging said guide surfaces.

2. A ladder tray assembly according to claim 1 wherein said slides further comprise locking which releasably lock the slides with respect to the tray.

3. A ladder tray assembly according to claim 1 wherein each said ladder tray support is of general U-shape having a horizontal bridge portion flanked by said two upstanding legs, means securing the bridge portions together for mutual pivoting movement, the lengths of said legs being such that said bridge portions can bear against surfaces of a ladder structure when said ladder tray support is fastened to said ladder structure surfaces.

4. A ladder tray assembly according to claim 3 wherein the upper ends of said legs engage surfaces of respective said slides, said upper ends containing threaded apertures which are threadably engaged by respective screws, each screw upon tightening bearing against a said guide surface and locking said screws engaged end, and thereby its engaged slide, against movement with respect to said guide surfaces.

5. A ladder tray assembly according to claim 1 wherein said slides further comprise locking means which releasably lock the slides with respect to the tray.

6. A ladder tray assembly according to claim 1 wherein each said end flange has an access notch in its upwardly projecting flange portion which permits slides to be positioned for slidable engagement with said flange surfaces and removed therefrom.

7. A ladder tray assembly according to claim 1, wherein said flange surrounds the periphery of said panel.

8. A ladder tray assembly according to claim 1 wherein said panel contains apertures near its front edge, and further comprising clips shaped to retain a front portion of said panel relative to a ladder structure with walls of said apertures engaging such ladder.

9. A ladder tray assembly comprising:

a tray having a panel bordered by a pair of transverse sides and a pair of ends;

ladder engaging means adjacent one of said transverse sides;

guide surfaces extending along the tray adjacent respective said ends, and slides engaging said guide surfaces, said guide surfaces guiding said slides for movement toward or away from one of said sides;

a pair of tray supports each having two upstanding legs, the upper ends of said legs pivotally engaging and depending from respective said slides;

a bridge connecting lower ends of said legs, the bridge comprising a pivot which permits said legs to pivot with respect to each other at their lower ends; and, said slides further including locking means which releasably lock the slides with respect to the tray.

10. A ladder tray assembly comprising a tray having a panel bordered by a pair of transverse sides and a pair of ends;

one of said transverse sides including ladder engaging means formed therein;

flanges projecting both upwardly and downwardly from said panel at its respective said ends, inner and outer surfaces of said flanges constituting guide surfaces;

slides having inner surfaces which define open mouth slots and which slidably engage said guide surfaces, said guide surfaces guiding each of said slides toward or away from each of said transverse sides;

a pair of tray supports each having two upstanding legs, pivot means on upper end portions of said legs pivotally engaging respective said slides, said legs depending from said slides; and a bridge connecting lower ends of said legs, the bridge comprising a pivot which permits said legs to pivot with respect to each other at their lower ends.

* * * * *